US008613242B2

(12) United States Patent
Peters

(10) Patent No.: US 8,613,242 B2
(45) **Date of Patent: *Dec. 24, 2013**

(54) ANTI-BALLISTIC SHELTERS

(71) Applicant: Peters Security International, Inc., Orange, CA (US)

(72) Inventor: Fred E. Peters, Orange, CA (US)

(73) Assignee: Peters Security International, Inc., Orange, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/659,507

(22) Filed: Oct. 24, 2012

(65) Prior Publication Data

US 2013/0098233 A1 Apr. 25, 2013

Related U.S. Application Data

(60) Provisional application No. 61/550,596, filed on Oct. 24, 2011.

(51) Int. Cl.
*F41H 5/24* (2006.01)

(52) U.S. Cl.
USPC ..... 89/36.02; 89/36.07; 89/916; 89/920

(58) Field of Classification Search
USPC ..... 89/36.01, 36.02, 36.07; 428/911
See application file for complete search history.

(56) References Cited

U.S. PATENT DOCUMENTS 4,325,309 A * 4/1982 King et al. ..... 109/49.5
4,358,984 A * 11/1982 Winblad ..... 89/36.08
4,391,178 A * 7/1983 Pagano ..... 296/187.07
4,403,012 A * 9/1983 Harpell et al. ..... 442/135
5,545,455 A * 8/1996 Prevorsek et al. ..... 428/76
5,824,940 A * 10/1998 Chediak et al. ..... 89/36.05
6,038,820 A * 3/2000 Rainbolt ..... 52/83
6,565,139 B2 * 5/2003 Bayerle et al. ..... 296/77.1
7,600,348 B1 * 10/2009 Kostka ..... 52/63
7,610,727 B2 * 11/2009 Toledo ..... 52/222
2003/0127122 A1 * 7/2003 Gower ..... 135/87
2004/0255769 A1 * 12/2004 Drackett ..... 89/36.09
2006/0169313 A1 * 8/2006 Witte ..... 135/143
2006/0181102 A1 * 8/2006 Lemieux ..... 296/37.13
2007/0039639 A1 * 2/2007 Duncan ..... 135/97
2009/0032076 A1 * 2/2009 Boldsen ..... 135/16
2011/0303254 A1 * 12/2011 Tucker et al. ..... 135/96
2012/0247313 A1 * 10/2012 Peters ..... 89/36.02
2012/0248837 A1 * 10/2012 Peters ..... 297/239
2012/0295057 A1 * 11/2012 Atorrasagasti ..... 428/101

* cited by examiner

*Primary Examiner* — Bret Hayes
(74) *Attorney, Agent, or Firm* — Richard D. Clarke

(57) ABSTRACT

The present invention is directed to methods of manufacturing Anti-ballistic Shelters such as Quonset buildings or huts, tents, pipe, rod, tubular and other frame structures, doors, room dividers, cots, pads and umbrellas using soft armor fabric or hard armor materials. Soft armor consists of flexible high-strength layered anti-ballistic material attached to a frame and layered in at least two directions. Soft armor requires an area of flexibility or expansion to work effectively when struck by a projectile along with a very secure attachment. With the design disclosed within this application the soft armor fabric is affixed to frameworks by an inverted "T" fabric construction method or which allows the flexibility or expansion required for maximum anti-ballistic protection within the shelter.

20 Claims, 10 Drawing Sheets

ANTI-BALLISTIC SHELTERS

This application incorporates by reference U.S. patent application Ser. Nos. 13/079,551 and 13/341,278.

FIELD OF THE INVENTION

This application provides a unique construction of Anti-ballistic Shelters for personal and group use which are both portable and fixed in location. More particularly, protective elements of the Anti-ballistic Shelters will consist of layers of flexible anti-ballistic fabric, known as soft armor, layered in at least two directions attached to Quonset hut buildings or other shelters, pipe, rods or other tubular frame structures, room dividers, panels, doors, cots, mattresses, pads, umbrellas and tents.

BACKGROUND OF THE INVENTION

This application describes new and unique methods using the latest design of anti-ballistic protection available in the construction of a wide variety of anti-ballistic shelters. Presently these materials are fabricated using not only Aramid fibers and KEVLAR® from DuPont, but also polyethylene fibers and GOLD SHIELD®, which is a KEVLAR® based material, and SPECTRA SHIELD®, which is polyethylene based material, both available commercially from Honeywell, GOLD SHIELD® and SPECTRA SHIELD® that are high strength synthetic fibers impregnated in partially cured resin for use in anti-ballistic material. Moreover, both of the Honeywell materials can be used as layered soft armor as well as in hard armor when they are autoclaved or compression molded into anti-ballistic components for construction of the Anti-ballistic Shelters, as shown and described. Other similar materials manufactured by any number of providers, of like purpose and functionality is also anticipated by this disclosure.

Bullet proofing or bullet-resistance is the process of making something capable of stopping a bullet or similar high velocity projectiles e.g. shrapnel. The term bullet resistance is often preferred because few, if any, practical materials provide complete protection against all types of bullets, or multiple hits in the same location. Bullet designs vary widely, not only according to the particular firearm used (e.g. a 9×19 mm Parabellum caliber hollowpoint handgun cartridge will have inferior penetration power compared to a 7.62×39 mm assault rifle cartridge), but also within individual cartridge designs. As a result, whilst so-called "bullet-proof" panels may successfully prevent penetration by standard 7.62×39 mm bullets containing lead cores, the same panels may easily be defeated by 7.62×39 mm armor piercing bullets containing hardened steel penetrators.

Bullet-resistant materials, also called ballistic materials or, equivalently, anti-ballistic materials, are usually rigid, but may be supple. They may be complex, such as KEVLAR®, LEXAN®, and carbon fiber composite materials, or they may be basic and simple, such as steel or titanium. Bullet resistant materials are often used in law enforcement and military applications, to protect personnel from death or serious injuries.

With the advent of new materials and the improvement of manufacturing processes, items like ballistic-proof or bullet resistant structures can become practical. It is well known that the construction of bullet-proof vests is done by applying multiple layers of fabric woven from an aramid fiber together, which is sold by Du Pont under the Trade Mark KEVLAR, and has been done for many years. It can be used in a flexible state or laminated in a more rigid configuration. The success of the product is attained by multiple layers of the semi-impregnable flexible structure. This material combines high penetration resistance with lightness and flexibility but until presently no one has endeavored to manufacture items like Anti-ballistic Shelters of this material.

There is a growing need for methods of self-protection in an increasingly wide variety of locations. In the modern world, crimes and attacks committed by persons with guns are an ever more common occurrence. In the past, police personnel and military personnel have been the primary targets of gunfire which has been directed toward them during work or duty. Because of this continual risk of harm, bullet resistant vests and shields have been developed which may be deployed or worn on the user's body as a protective component of their work attire. Such devices, when employed for protection against weapons fire have worked fairly well in preventing a high velocity bullet or shell from penetrating the wearer's body since the velocity is slowed considerably.

It has been made clearly evident by the shooting at Fort Hood that additional means of self-protection has become very necessary. The mass shooting took place on Nov. 5, 2009, at Fort Hood, the most populous U.S. military installation in the world, located just outside Killeen, Tex. In the course of the shooting, a single gunman killed 13 people and wounded 29 others. According to witnesses, Army reserve Captain John Gaffaney attempted to stop Hasan, either by charging him or throwing a chair at him, but was mortally wounded in the process. Civilian physician assistant Michael Cahill also tried to charge Hasan with a chair before being shot and killed. Army reserve Specialist Logan Burnette tried to stop Hasan by throwing a folding table at him, but he was shot in the left hip, fell down, and crawled to a nearby cubicle.

Consequently, there exist a need for a methods which will give anti-ballistic protection to a wide variety of structures. It has been found through the endeavors of the inventor and the patent search that there is no method on the market and no apparent patents reviewed that have similar characteristics to the unique method of creating Anti-ballistic Shelters.

Numerous innovations for the Anti-ballistic Shelter have been provided in the prior art that are described as follows. Even though these innovations may be suitable for the specific individual purposes to which they address, they differ from the present design as hereinafter contrasted. The following is a summary of those prior art patents most relevant to this application at hand, as well a description outlining the difference between the features of the Anti-ballistic Shelter and the prior art.

U.S. Pat. No. 5,392,686 of Wilfred A. Sankar describes a protective shield, comprising a frame. The frame having a frame top, a frame bottom, frame sides, and frame upper sides between the frame sides and frame top. The shield further having a front panel and a back panel, each made from a bullet-proof plastic fabric such as KEVLAR. The shield has a viewing window, made of a transparent bullet-proof material, such as LEXAN. A shield inner channel is mounted between the front panel and back panel. A first extension is mounted within the shield inner channel that slidably extends from the shield, bottom for use, and retracts for storage.

This patent describes a protective shield and it's construction only and does not endeavor to make any reference to using the design in the construction of a wide range of Anti-ballistic Shelters, doors, cots, pads, umbrellas and tents and does not describe the unique method of attaching the anti-ballistic materials to various pipe frame structures.

U.S. Pat. No. 4,412,495 of Wilfred A. Sanker describes a Total Body Protective device including a pair of fabric panels made of bullet-proof material, handles on an upper of the panel pieces for holding the device in front of a person, and a window through the top panel piece for observing an assailant, and means to roll up or fold the device when not in use.

This patent describes a Total Body Protective device but does not deal with sheltering devices such as Quonset buildings or huts, pipe frame structures, doors, cots, pads, umbrellas and tents.

U.S. Pat. No. 8,017,048 of James H. Carter describes an emergency shelter that includes a domed foam structure that is constructed on-site or at a remote location from foam that can be mixed on-site. The structure can be made on-site by spraying foam in a flowable state in a predetermined pattern to build up walls to form a dome. The foam can be sprayed, for example, in a substantially helical pattern from a centrally located spray nozzle that is rotated to deposit a finite-thickness increment of foam over a time period sufficient that, by the time the nozzle reaches a previously sprayed area, the foam already deposited has had time to cure.

This patent describes an emergency shelter that includes a domed foam structure but does not use the flexible anti-ballistic fabric.

U.S. Pat. No. 8,001,987 of Marty Williams describes a support system for tents and other shelters. The support system includes base support members that are in the shape of an arch. These base support members are secured in a desired configuration by an upper support member that is in the shape of a circle or other geometrical shape. A roof support may be added as well. The size and configuration of the shelter may be easily changed by adding or deleting the number of base support members.

This patent describes a support system for tents and other shelters but additionally does not use the flexible anti-ballistic fabric.

U.S. Pat. No. 7,882,849 of Matt Franta describes a flame-resistant fabric for shelters including a flame-resistant interior layer, a flame-resistant, insulating middle layer adjacent the interior layer, a flame-resistant exterior layer adjacent the insulating middle layer, and at least one threaded seam quilting the insulating middle layer between the interior layer and the exterior layer to form a flame-resistant fabric. The flame-resistant fabric is capable of being formed into a flame-resistant, insulated shelter for use in extreme weather.

This patent describes flame-resistant fabric for shelters but does address the use of flexible anti-ballistic fabric.

U.S. Pat. No. 7,856,761 of James Heselden a protective shelter that can be used to provide protection within a war zone, and which can be readily assembled in a quick, secure and reliable manner. The shelter is formed of opposite outer walls and a roof structure extending there between, wherein the roof structure comprises a plurality of tray members supported by beam supports and in which the plurality of tray members is arranged to receive earth, sand or aggregate material so as to provide a first layer of protection via the roof structure. The tray members can be supported by beams serving to define a shallow arch across the shelter such that the internal height of the shelter centrally, and away from the opposite walls, which is greater than the height of the said walls.

This patent describes a protective shelter that can be used to provide protection through the use of earth, sand and aggregate material within a war zone, but does not address the use of the flexible anti-ballistic fabric used on the Anti-ballistic Shelters disclosed within this application.

None of these previous efforts, however, provides the benefits attendant with the Anti-ballistic Shelters. The present designs achieves their intended purposes, objects and advantages over the prior art devices through a new, useful and unobvious combination of method steps and component elements, with the use of a minimum number of functioning parts, at a reasonable cost to manufacture, and by employing readily available materials.

In this respect, before explaining at least one embodiment of the methods of manufacturing Anti-ballistic Shelters in detail it is to be understood that the Anti-ballistic Shelters are not limited in its application to the details of construction and to the arrangement, of the components set forth in the following description or illustrated in the drawings. The Anti-ballistic Shelters are capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for designing of other structures, methods and systems for carrying out the several purposes of the present methods of manufacturing Anti-ballistic Shelters. It is important, therefore, that the claims be regarded as including such equivalent construction insofar as they do not depart from the spirit and scope of the present application.

SUMMARY OF THE INVENTION

The principal advantage of the Anti-ballistic Shelters are to provide a full range of shelter structures capable of ballistic protection.

Another advantage of Anti-ballistic Shelters is to supply a full range of numerous shelter structures capable of ballistic protection in portable modular designs.

Another advantage of Anti-ballistic Shelters is to supply a wide range of items that can be relatively inexpensive to manufacture.

Another advantage is to supply Anti-ballistic Shelters fabricated of a variety of materials including multiple layers of soft fabric woven material from an aramid fiber which is sold by Du Pont under the registered trademark KEVLAR®, or other providers, and will resist and absorb the impact of a bullet and referred to in this application as soft armor.

Another advantage of the Anti-ballistic Shelters is that the unique mounting of the anti-ballistic material can be used on different items such as doors, room dividers, cots, umbrellas and tents.

Another advantage of the Anti-ballistic Shelters is that camouflage and water resistant materials or coatings can easily be added to the construction materials.

Another advantage of the Anti-ballistic Shelters is that they can be used in a wide range of applications from military, governmental, schools and private applications, as well as personal applications.

The foregoing has outlined some of the more pertinent advantages of the methods of manufacturing Anti-ballistic Shelters. These advantages should be construed to be merely illustrative of some of the more prominent features and applications of the intended methods of manufacturing Anti-ballistic Shelters. Many other beneficial results can be attained by applying the disclosed methods of manufacturing Anti-ballistic Shelters in a different manner or by modifying the invention within the scope of the disclosure. Accordingly, other advantages and a fuller understanding of the methods of manufacturing Anti-ballistic Shelters may be had by referring to the summary of this application and the detailed description of the embodiments in addition to the scope of the methods of manufacturing Anti-ballistic Shelters defined by the claims taken in conjunction with the accompanying drawings The methods of manufacturing Anti-ballistic Shelters make use of materials that are fabricated using not only Aramid fibers such as the para-aramid compound KEVLAR® from DuPont, but also polyethylene fibers and GOLD SHIELD® woven polyethylene fibers, which is combined with para-aramids such as KEVLAR®, and SPECTRA SHIELD®, which is polyethylene based woven fiber material, both available commercially from Honeywell, and other providers. GOLD SHIELD® and SPECTRA SHIELD® are high strength synthetic fibers impregnated in partially cured resin for use in anti-ballistic material. Moreover, both of the Honeywell materials can additionally be used as layered soft armor as well as in hard armor when they are autoclaved or compression molded into anti-ballistic components for construction of the Anti-ballistic Shelters. This material combines high penetration resistance with lightness of weight. Hereinafter, GOLD SHIELD® and SPECTRA SHIELD® polyethylene woven fibers and KEVLAR® para-aramid fibers will be referred to simply as GOLD SHIELD®, SPECTRA SHIELD® and KEVLAR®.

Soft armor requires an area of flexibility or expansion to work effectively when struck by a projectile. If these materials are completely restricted their effectiveness is diminished. With the unique design of this application the soft armor can be attached to a pipe frame structure allowing the flexibility or expansion required for maximum protection. Using these methods of manufacturing a wide range of Anti-ballistic Shelters may be constructed, including but not limited to, Quonset buildings or huts, tents, pipe, rod and other tubular or other frame structures, cots, pads room dividers, doors and umbrellas.

The Anti-ballistic Shelters have many very similar applications. The Quonset Hut style of Anti-ballistic Shelter with horizontal steel pipe members and hoop style pipe supporting members is a prime example. Additional door support pipe members and the ground level pipe members will be held together by the means of Speed-Rail Fittings® made by Hollaender™ Manufacturing Inc. for aluminum fittings or Kee Klamp™ pipe fittings for steel fittings, in one possible example. The upper anti-ballistic fabric surface the front wall anti-ballistic fabric and rear wall will be covered with layers of flexible anti-ballistic fabric (soft armor) layered in two directions. Varying numbers of horizontal pipe members and hoop style pipe supporting members may vary depending upon where larger numbers are required for adequate protection from possible larger projectiles. A variety of shapes of pipe, rod, tubular and other frame structures including tents, lean-tos and canopies can be constructed in this manner and will remain within the scope of this application.

An anti-ballistic material fabric clamp has been designed having upper clamp member and lower clamp member each having a plurality of teeth on the gripping edges. A nut and bolt will secure the two halves tightly together. With the potential forces exerted on the material by a projectile the fabric clamps must be very rugged and closely spaced.

A bi-directional pipe clamp has been designed to attach the horizontal members to the curved hoop style pipe supporting members. The bi-directional pipe clamp consists of four common clamping segments with elongated holes where the two pairs of the clamping segments will interlock. Orifices will be used by the bolts and nuts to clamp the bi-directional pipe clamp to the horizontal pipe member and the hoop style pipe supporting members. The benefit in using these fittings is that they are made of steel not aluminum and much less subject to breakage under high impacts.

An additional means of attachment of the anti-ballistic fabric surface is by using a fabric inverted "T" construction method with a breakaway stitch and a holding stitch over the structural members. The inverted "T" construction method has been designed where the anti-ballistic fabric surface is loosely covering the supporting pipe members with two or more rows of stitches running the length of the section. The breakaway stitches on either side of the supporting members will absorb the initial shock and most likely break away while the holding stitch will receive less shock and will resist being completely broken away. This method may use adhesive for the same purpose or a combination of both adhesive and stitching to accomplish the desired task.

An additional use will be in a wall tents, pup tents and dome tents where the anti-ballistic fabric covering will be attached to the sides walls and the top.

Another application will use the attachment of the anti-ballistic fabric to a pipe frame door or room divider with the inverted "T" construction method or Speed-Rail Fittings® or other appropriate fittings at the corners and pipe intersections of the unit. Fabric clamps, as one possible method, are used to secure the fabric surface completely around the individual pipe segments. Additionally, a progressive expandable sleeve with breakaway stitching and progressively stronger stitching is another possible way to construct the Anti-Ballistic Shelters herein.

Still another possible application is the attachment of the anti-ballistic fabric to a pipe frame cot by using the inverted "T" construction method or fabric clamps to secure the anti-ballistic fabric surface completely around the pipe segments with Speed-Rail Fittings® at the corners and intersections. This application could be used on a conventional wood or aluminum or other material cot and still remain within the scope of this application, but it would not have the structural strength of the steel pipe frame construction.

A further application will be the attachment of the anti-ballistic fabric to the inside of an existing door. Soft armor has been placed on the outer surface of the inside of the door (this is the protected side as opposite of the outside or perpetrator side of the door) because it requires an area of flexibility or expansion to work effectively when struck by a projectile. If these materials are completely restricted their effectiveness is diminished. The anti-ballistic fabric is held in place by the means of threaded fasteners.

The anti-ballistic fabric can additionally be used as a covering for a pad, a cushion or a mattress with or without handles where it can be held up in a defensive position.

The unique use of anti-ballistic fabric is also anticipated as a covering for an umbrella with the conventional shepherds hook or other common use handle or an additional second hand support grip with or without a defensive spike on the top. The umbrella has bendable rib members in the manner of a conventional umbrella, and may have a sliding opening mechanism that is held in the open position by the means of spring loaded latching mechanism. The sliding opening mechanism will have extension arms extending out to each of the rib members supporting the umbrella in the open position. The design of the umbrella may have fewer or greater bendable rib members compared to the conventional umbrella with flexible ribs is to accommodate the heavier weight of the anti-ballistic fabric. The number of frame members or ribs used will depend upon the degree of bullet resistance required.

With respect to the above description then, it is to be realized that the optimum dimensional relationships of the methods of manufacturing Anti-ballistic Shelters, to include variations in size, materials, shape, form, function and manner of operation assembly and use, are deemed readily apparent and obvious to one skilled in the art, and all equivalent relationships to those illustrated in the drawings and described in the specification are intended to be encompassed by the present methods of manufacturing Anti-ballistic Shelters. Therefore, the foregoing is considered as illustrative only of the principles of this application. Further, since numerous modifications and changes will readily occur to those skilled in the art, it is not desired to limit the methods of manufacturing Anti-ballistic Shelters to the exact construction and operation shown and described, and accordingly, all suitable modifications and equivalents may be resorted to, falling within the scope of this application.

BRIEF DESCRIPTION OF THE DRAWINGS

The accompanying drawings, which are incorporated in and form a part of this specification, illustrate embodiments of the Anti-ballistic Shelters and together with the description, serve to explain the principles of this application.

Figure 1:
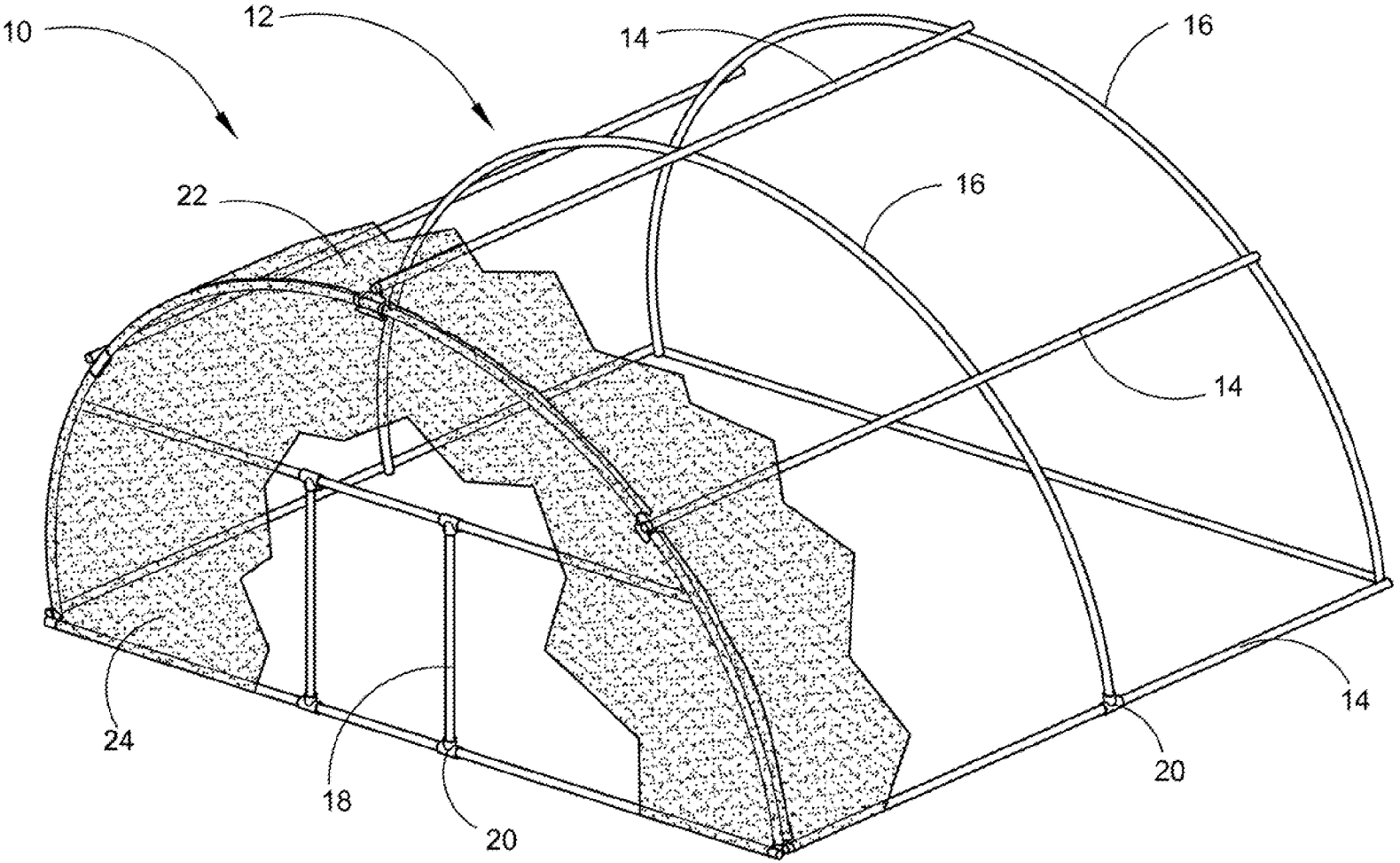
FIG. 1 depicts a perspective illustration of a Quonset hut style of Anti-ballistic Shelter.

For a fuller understanding of the nature and advantages of the Anti-ballistic Shelters, reference should be had to the following detailed description taken in conjunction with the accompanying drawings which are incorporated in and form a part of this specification, illustrate embodiments of the design and together with the description, serve to explain the principles of this application.

DETAILED DESCRIPTION OF THE PREFERRED EMBODIMENTS

As required, detailed embodiments of the present methods of manufacturing Anti-ballistic Shelters are disclosed herein, however, it is to be understood that the disclosed embodiments are merely exemplary of the methods of manufacturing Anti-ballistic Shelters that may be embodied in various forms. Therefore, specific functional and structural details disclosed herein are not to be interpreted as limiting, but merely as basis for the claims and as a representative basis for teaching one skilled in the art to variously employ the present design in virtually any appropriately detailed structure.

Referring now to the drawings, wherein similar parts of the methods of manufacturing Anti-ballistic Shelters 10 is depicted as a steel pipe frame Quonset Hut style of Anti-ballistic Shelter 12 with horizontal pipe (or other) members 14 and hoop style pipe supporting members 16. Additional door support pipe members 18 and the ground level pipe members will be held together by the means of Speed-Rail Fittings® 20 made by Hollaender™ Manufacturing Inc. for aluminum fittings or Kee Klamp™ pipe fittings for steel fittings. The upper anti-ballistic fabric surface 22, the front wall anti-ballistic fabric 24 and rear wall not shown will be covered with layers of flexible anti-ballistic fabric (soft armor) layered in two directions. Varying numbers of horizontal pipe members 14 and hoop style pipe supporting members 16 may vary depending upon where larger numbers are required for adequate protection from possible larger projectiles. A variety of shapes of pipe frame structures including tents, lean-tos and canopies can be constructed in this manner and will remain within the scope of this application.

Figure 2:
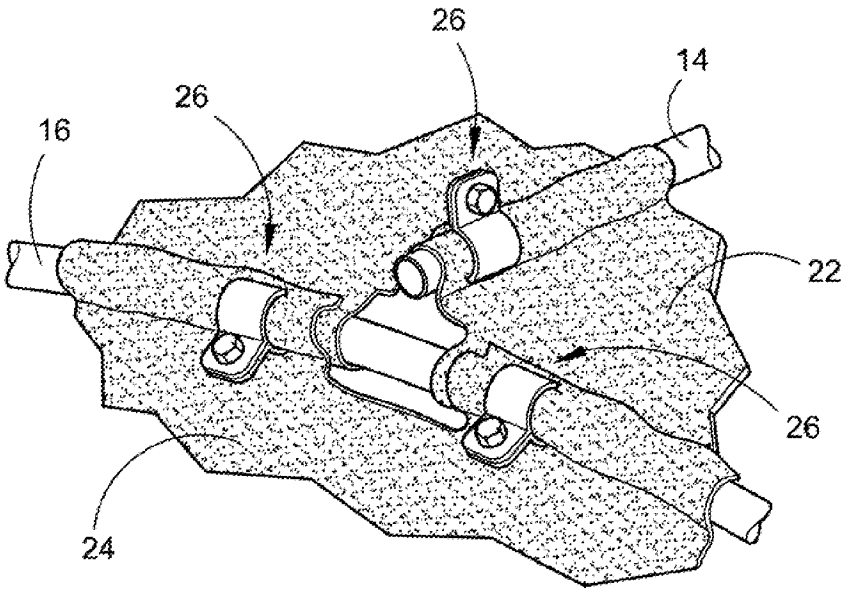
FIG. 2 depicts a perspective illustration of the attachment of the anti-ballistic fabric surface by using clamps to the supporting frame structure.

FIG. 2 depicts a perspective illustration of the attachment of the upper anti-ballistic fabric surface 22 to the horizontal pipe members 14 and front wall anti-ballistic fabric 24 to the hoop style pipe supporting members 16 with fabric clamps 26. Having potential forces exerted on the material by a projectile the fabric clamps must be very rugged and closely spaced.

Figure 3:
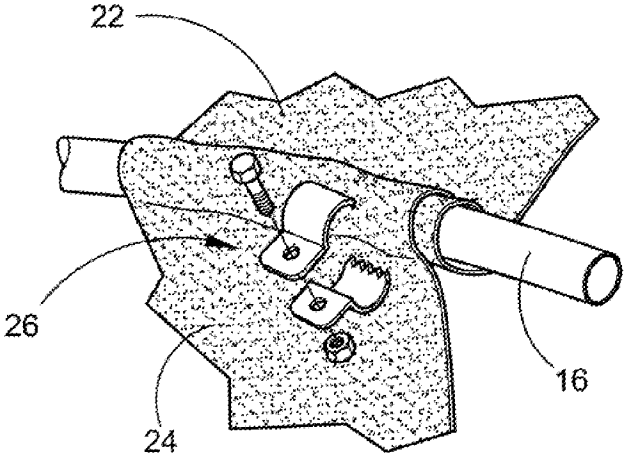
FIG. 3 depicts a perspective illustration of the method of attachment of the anti-ballistic fabric surface to the curved support structure by using clamps.

FIG. 3 depicts a perspective illustration of the method of attachment of the anti-ballistic material to the curved support structure by rolling the material around the pipe members and using multiple fabric clamps 26. Here again the potential forces exerted on the material by a projectile the fabric clamps must be very rugged and closely spaced.

Figure 4:
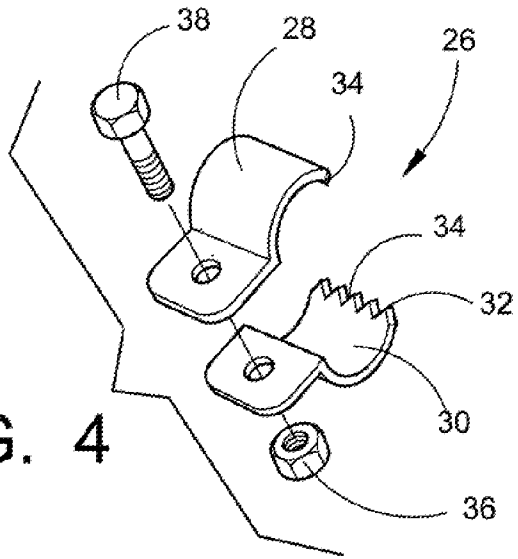
FIG. 4 depicts an exploded perspective view of the anti-ballistic fabric surface clamping means.

FIG. 4 depicts an exploded perspective view of the anti-ballistic material fabric clamp 26 illustrating the upper clamp member 28 and lower clamp member 30 having a plurality of teeth 32 on the gripping edges 34. A nut 36 and bolt 38 will secure the two halves tightly together.

Figure 5:
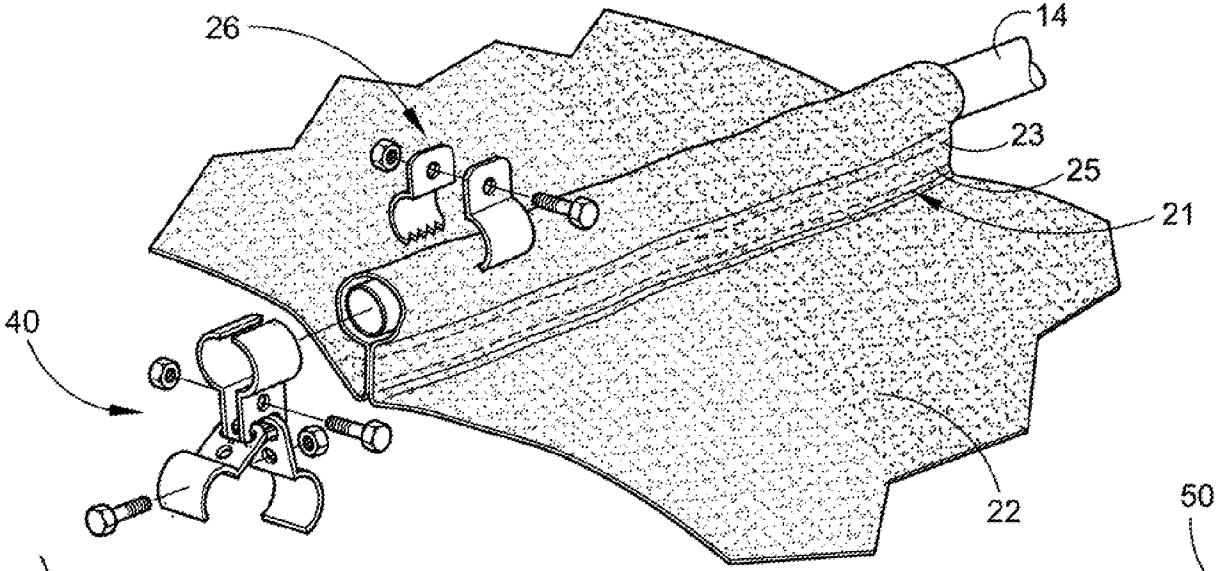
FIG. 5 depicts a perspective illustration of the attachment of the anti-ballistic fabric surface to the horizontal support structure and the unique bi-directional pipe clamp.

FIG. 5 depicts a perspective illustration of the attachment of the anti-ballistic upper fabric surface 22 to the horizontal support structure 14 and the unique bi-directional pipe clamp 40. The bi-directional pipe clamp 40 has been designed to raise the horizontal pipe members 14 away from the hoop style pipe supporting members 16 (as shown in FIG. 1) and to give enough space for the fabric clamps 26 to secure the upper anti-ballistic fabric surface 22 completely around the horizontal pipe members 14 with the added benefit of the inverted "T" construction method 21 with a breakaway stitch 23 and a holding stitch 25.

Figure 6:
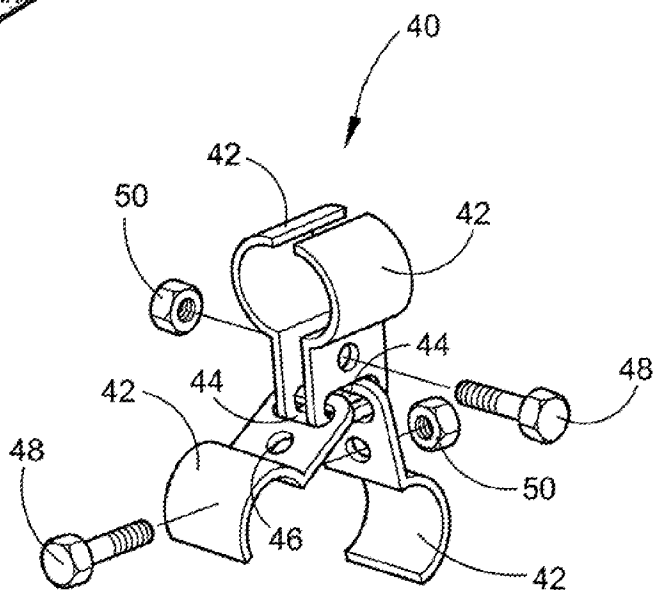
FIG. 6 depicts an exploded perspective illustration of the bi-directional pipe clamp used to attach the horizontal member to the curved support structure.

FIG. 6 depicts an exploded perspective illustration of the bi-directional pipe clamp 40 used to attach the horizontal member 14 to the curved hoop style pipe supporting members 16. The bi-directional pipe clamp 40 consists of four common clamping segments 42 with elongated holes 44 where the two pairs of the clamping segments 42 will interlock. Orifices 46 will be used by the bolts 48 and nuts 50 to clamp the bi-directional pipe clamp 40 to the horizontal pipe member 14 and the hoop style pipe supporting members 16 (as shown in FIG. 1). The benefit in using these fittings is that they are made of steel not aluminum and much less subject to breakage under high impacts.

Figure 7:
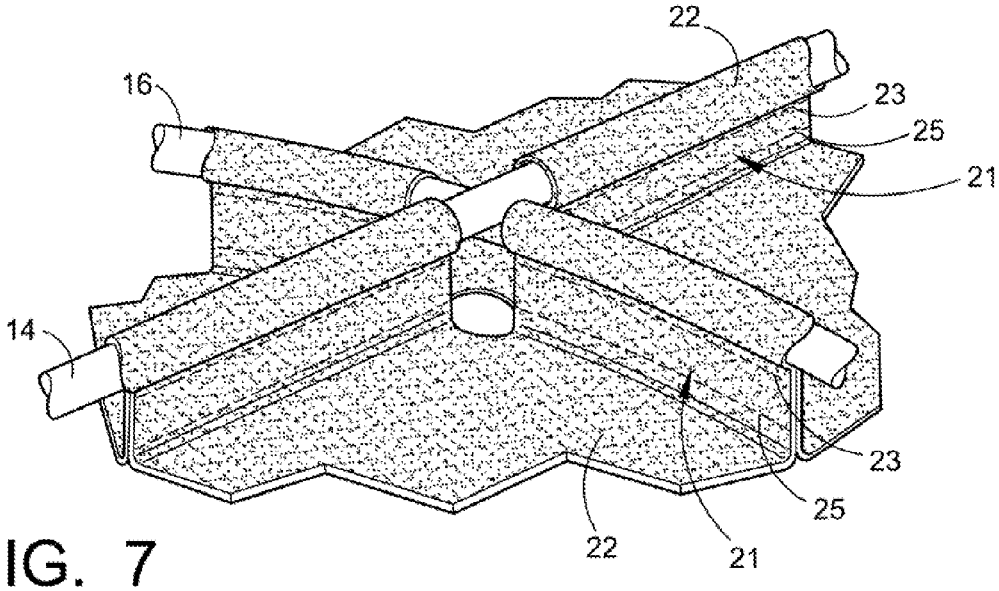
FIG. 7 depicts a perspective illustration of the attachment of the anti-ballistic fabric surface using the fabric inverted "T" construction method.

FIG. 7 depicts a perspective illustration of the attachment of the upper anti-ballistic fabric surface 22 using the fabric inverted "T" construction method 21 with fabric stitches 23 and 25 over the horizontal pipe member 14 and the hoop style pipe supporting members 16. The inverted "T" construction method 21 has been designed where the anti-ballistic fabric surface 22 is loosely covering the supporting pipe members 14 and 16 with two or more stitches 23 and 25 running the length of the section. This creates a progressive expandable sleeve. The stitches 23 and 25 on either side of the supporting pipe members 14 and 16 will absorb the initial shock and most likely one or more of these stitches will break away while one or more of the stitches will receive less shock and will resist being completely broken away, depending upon the direction and angle of the projectile. In this way, the layers of fabric stop a projectile from penetration, by the stitches breaking away until they hold. The number of layers and the quantity of stitches will depend upon the degree of bullet resistance required.

Figure 8A:
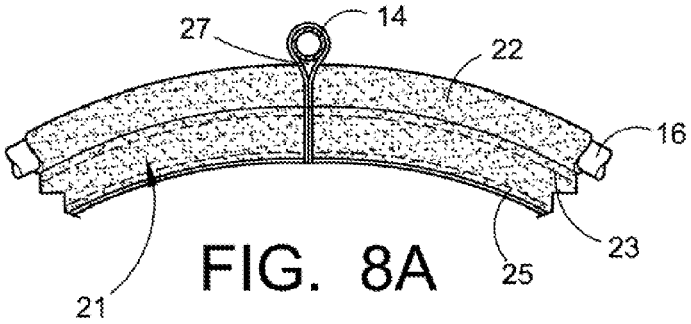
FIG. 8A depicts an end view of the cross-over of the horizontal pipe frame and the hoop style pipe member with the anti-ballistic fabric surface covering.

FIG. 8A depicts an end view of the cross-over of the horizontal pipe member 14 and the hoop style pipe supporting member 16 illustrating the gap 27 with loose upper anti-ballistic fabric surface 22 covering the horizontal pipe member 14.

Figure 8B:
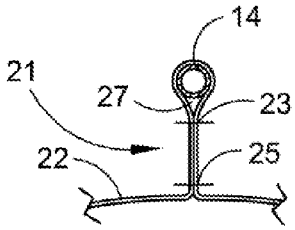
FIG. 8B depicts an end view of the inverted "T" construction method with a breakaway stitch and a holding stitch in the anti-ballistic fabric surface.

FIG. 8B depicts an end view of the inverted "T" construction method 21 with a stitches 23 and 25 shown, and the gap 27 in the loose upper anti-ballistic fabric surface 22 clearly depicted. It must be understood that the inverted "T" construction method 21 is not limited to two lines of stitches but may have two or more and still remain within the scope of this application. The number of stitches and distance apart create a progressive expandable sleeve. The number of layers and the quantity of stitches will depend upon the degree of bullet resistance required.

Figure 9:
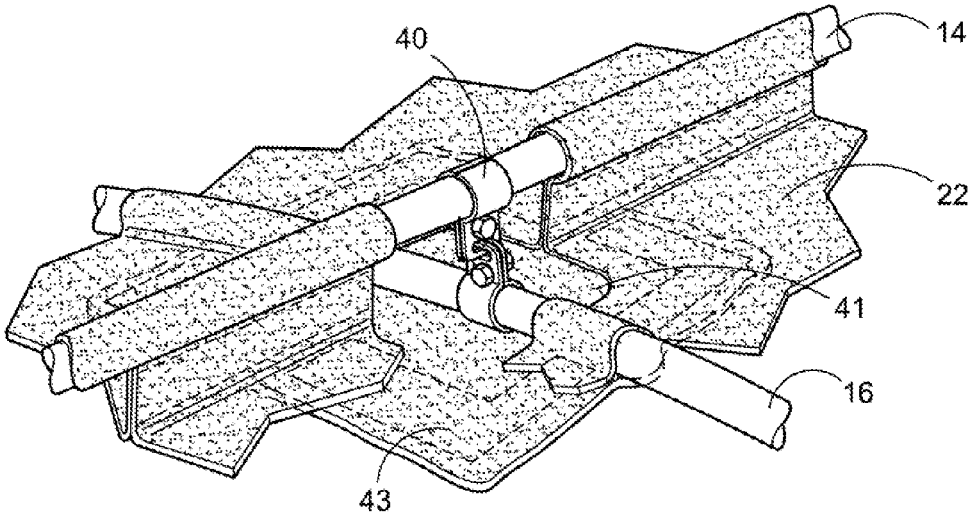
FIG. 9 depicts a perspective view of the cross-over of the horizontal pipe frame and the hoop style pipe member with the anti-ballistic fabric surface covering using the bi-directional pipe clamp and a soft or hard armor patch.

FIG. 9 depicts a perspective view of the cross-over of the horizontal pipe frame 14 with the hoop style pipe member 16 having the upper anti-ballistic fabric surface 22 and the bi-directional pipe clamp 40. The space below the intersection of the horizontal pipe frame 14 with the hoop style pipe member 16 creates an opening 41 in the upper anti-ballistic fabric surface 22 that will be closed with a patch 43 made from soft armor or hard armor material.

Figure 10:
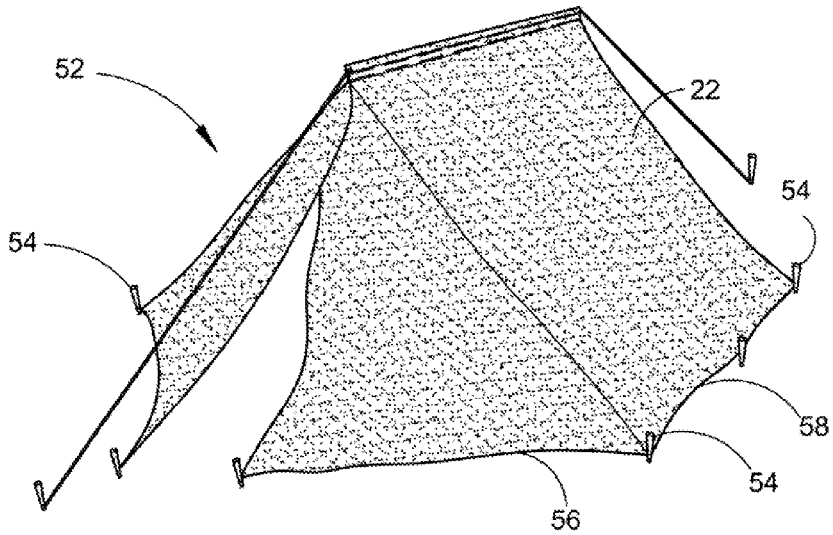
FIG. 10 depicts a perspective view of a conventional pup tent incorporating the anti-ballistic fabric surface.

FIG. 10 depicts a perspective view of a conventional pup tent 52 incorporating the anti-ballistic fabric surface 22. The perimeter of the pup tent will have a plurality of tent stakes 54 and a cable 56 along the lower edge 58.

Figure 11:
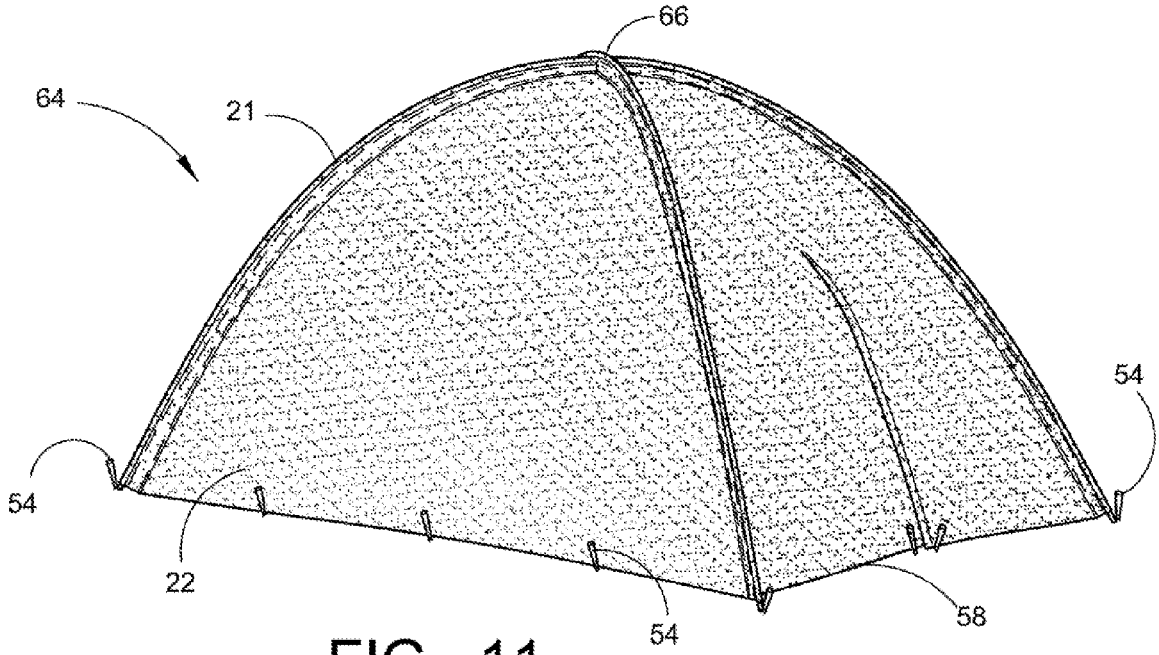
FIG. 11 depicts a perspective view of a conventional dome tent incorporating the anti-ballistic fabric surface.

FIG. 11 depicts a perspective view of a conventional dome tent 64 incorporating the anti-ballistic fabric surface 22 using the inverted "T" construction method 21 over the supporting flex poles 66 (not seen). A plurality of tent stakes 54 and a cable 56 along the lower edge 58 will support the lower edge. This illustration shows the basic dome tent 64 with two flex poles 66 (not seen) but it must be understood that two, four, six, eight, etc. or more of these poles may be used depending upon the size and degree of anti-ballistic protection required and will still remain within the scope of this application.

Figure 12:
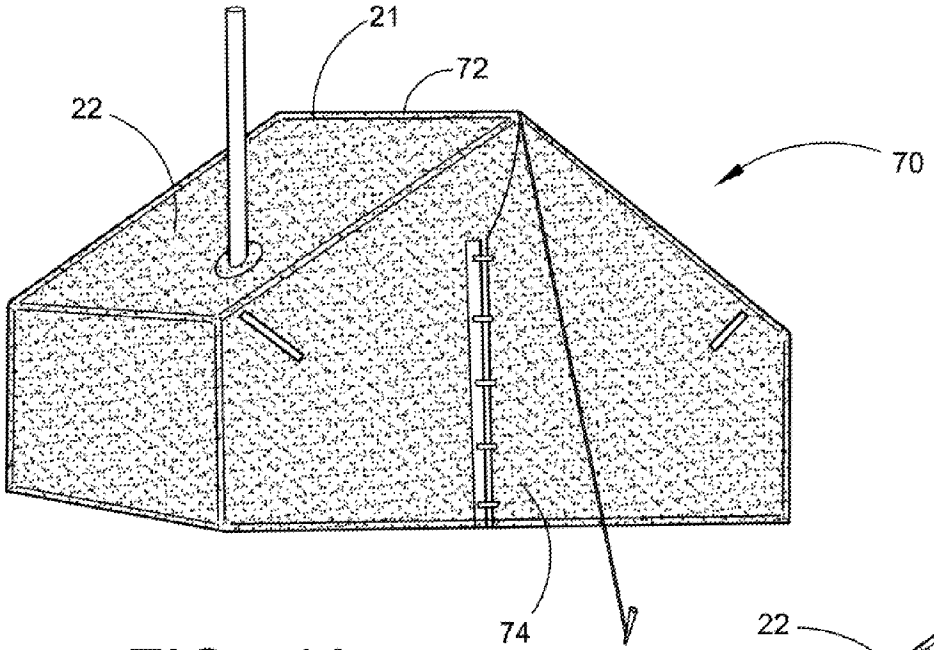
FIG. 12 depicts a perspective view of a wall tent with the door flaps closed.

FIG. 12 depicts a perspective view of a wall tent 70 with anti-ballistic fabric surface 22 using the inverted "T" construction method 21 on all four sides and top with a steel pipe frame work 72. The wall tent in this view has the overlapping door flaps 74 closed. It is anticipated that more sections may be added to the wall tent depending upon the need for space and they can be extended longitudinally with other frame and anti-ballistic fabric constructed sections.

Figure 13:
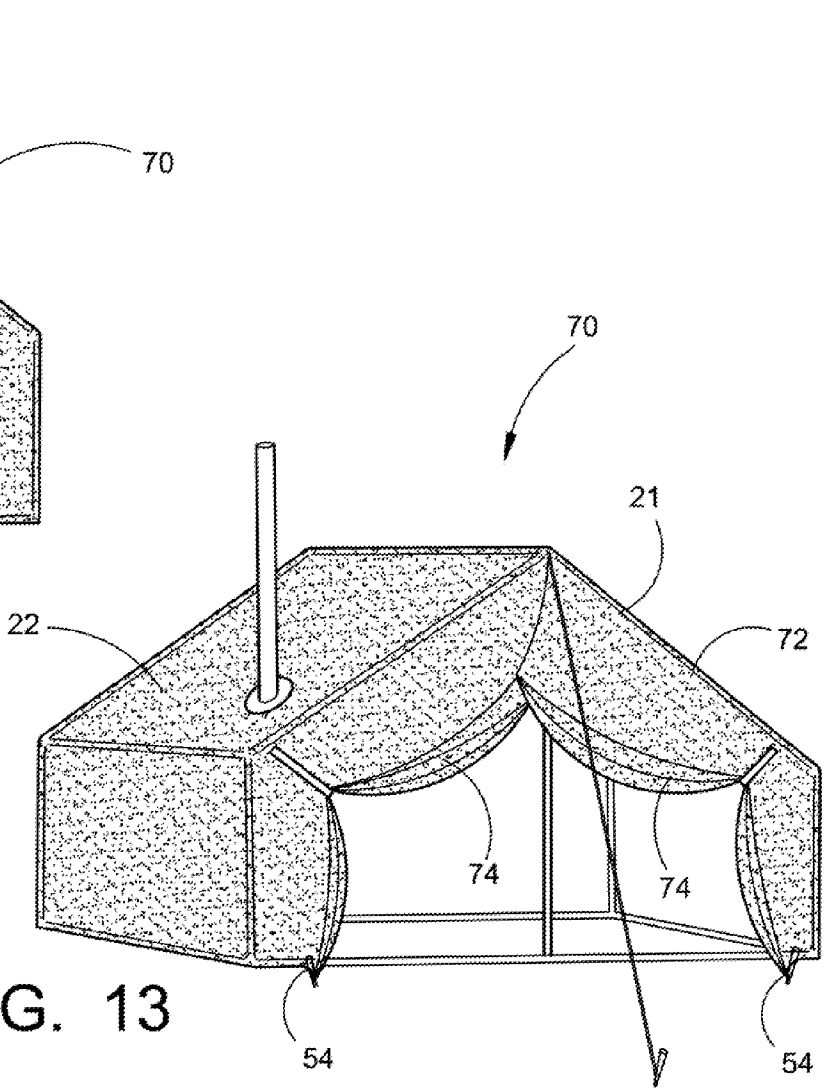
FIG. 13 depicts a perspective view of a wall tent with the door flaps open.

FIG. 13 depicts a perspective view of a wall tent 70 with the door flaps 74 held open by tent stakes 54. The wall tent in this view has the overlapping door flaps 74 opened. It is anticipated that more sections may be added to the wall tent depending upon the need for space and they can be extended longitudinally with other frame and anti-ballistic fabric constructed sections.

Figure 14:
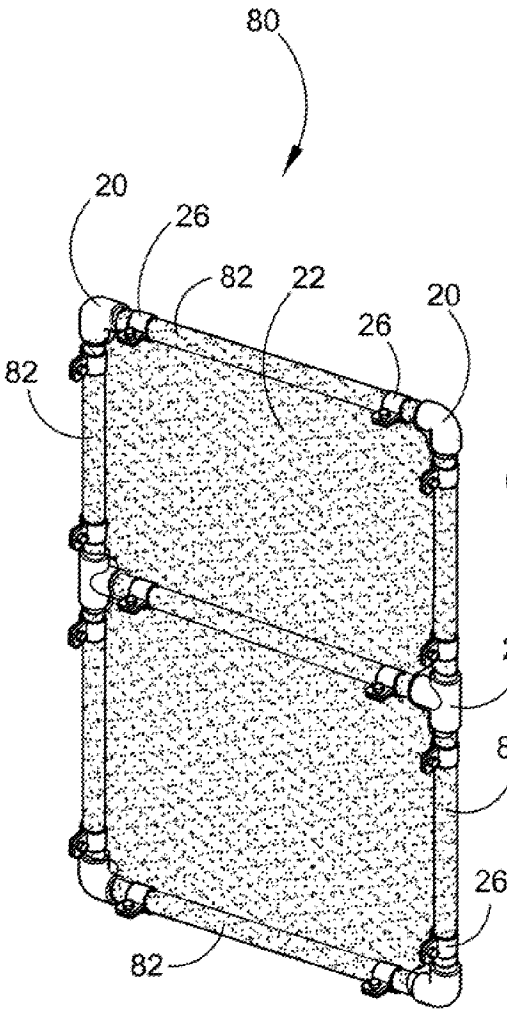
FIG. 14 depicts a perspective illustration of the attachment of the anti-ballistic fabric surface to a pipe frame door or room divider.

FIG. 14 depicts a perspective illustration of the attachment of the anti-ballistic fabric surface 22 to a pipe frame door or room divider 80 with Speed-Rail Fittings® 20 used at the corners and pipe intersections of the unit. Fabric clamps 26 are used to secure the anti-ballistic fabric surface 22 completely around the individual pipe segments 82. The inverted "T" construction method 21 will work equally well in this application.

Figure 15:
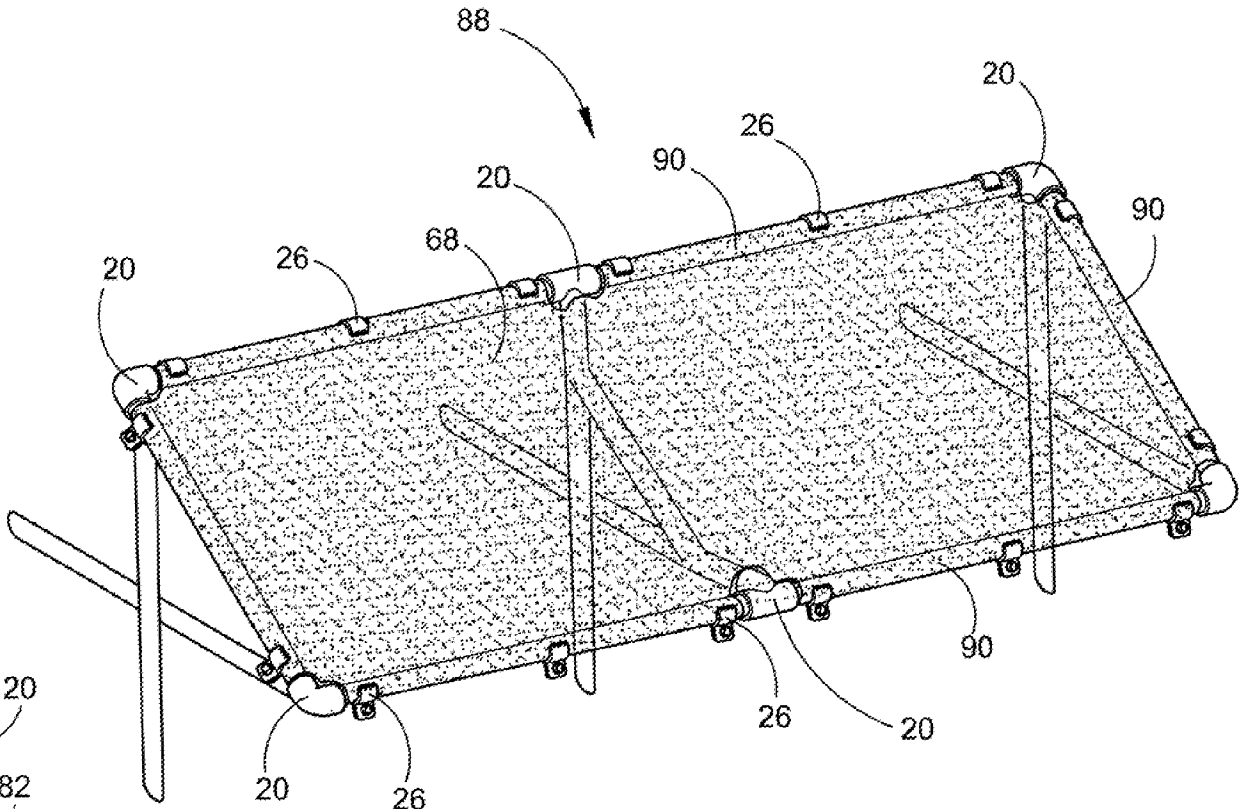
FIG. 15 depicts a perspective illustration of the attachment of the anti-ballistic fabric surface to a pipe frame cot.

FIG. 15 depicts a perspective illustration of the attachment of the anti-ballistic fabric surface to a pipe frame cot 88 by using the fabric clamps 26 to secure the anti-ballistic fabric surface 22 completely around the pipe segments 90 with Speed-Rail Fittings® 20 at the corners and intersections. The inverted "T" construction method again will work equally well in this application. This application could be used on a conventional wood or aluminum cot and still remain within the scope of this application, but it would not have the structural strength of the steel pipe frame construction. The cot sleeping surface 68 would act as a bullet resistant or bullet-proof shield, when easily and quickly picked up and held up, or transported as needed.

Figure 16:
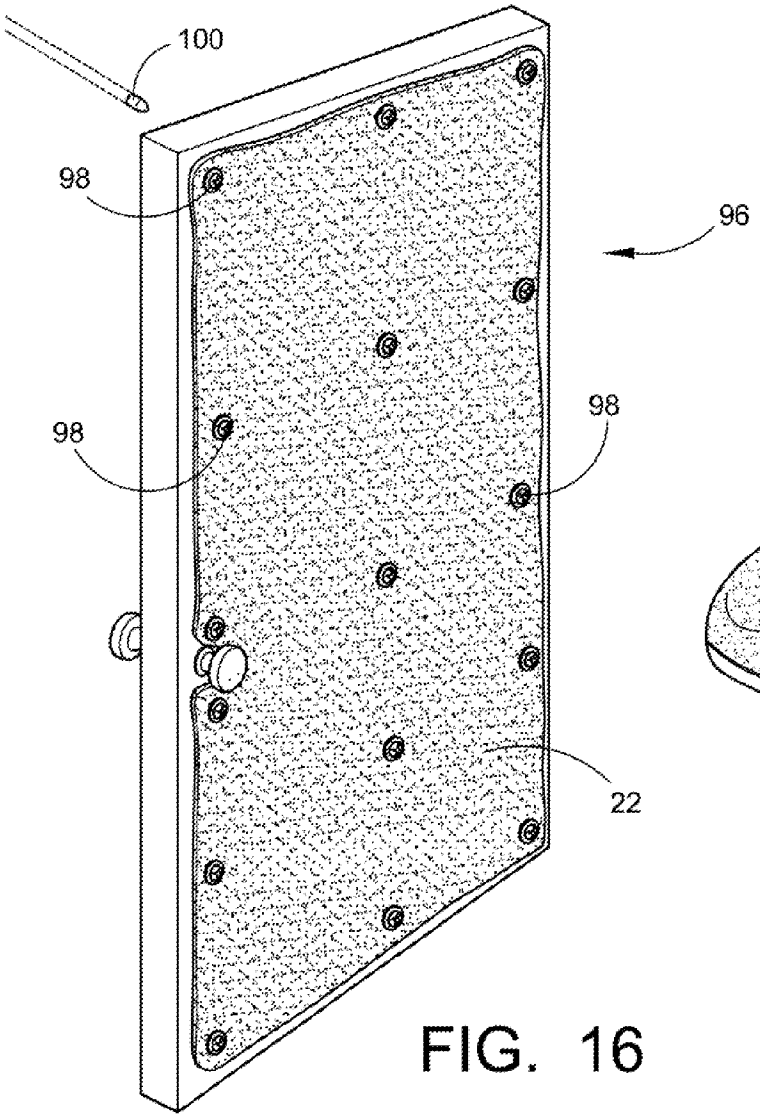
FIG. 16 depicts a perspective illustration of the attachment of the anti-ballistic fabric surface to the inside surface, or the protected side, of an existing door or room divider.

FIG. 16 depicts a perspective illustration of the attachment of the anti-ballistic fabric surface 22 to the inside surface (the protected side) of an existing door 78. Soft armor has been placed on the inside protected surface of the door because it requires an area of flexibility or expansion to work effectively when struck by a projectile. If these materials are completely restricted their effectiveness is diminished. The anti-ballistic fabric surface 22 is held in place by the means of multiple threaded fasteners 98. Other means for fastening are also anticipated, such as the use of adhesives, edge molding, or other fastening means. A bullet 100 is shown traveling towards the front outside, the perpetrator side, of the existing door indicating the maximum means of protection offered by the anti-ballistic fabric surface 22.

Figure 17:
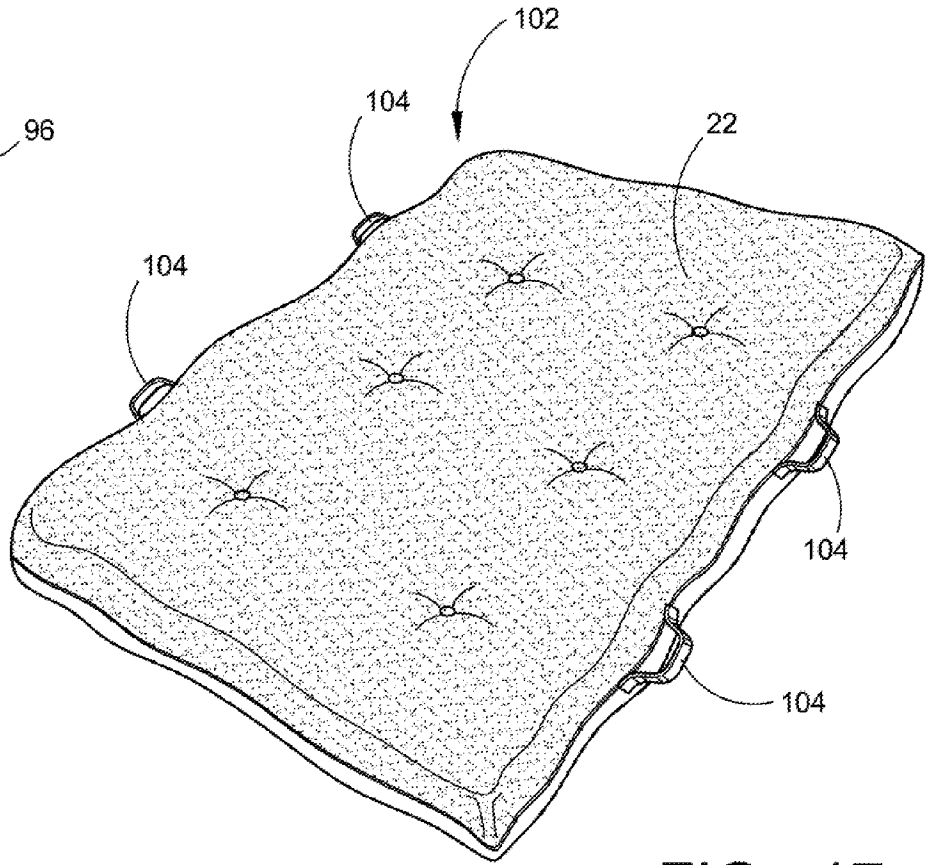
FIG. 17 depicts a perspective illustration of the anti-ballistic fabric surface used as a covering for a cushion, pad or mattress.

FIG. 17 depicts a perspective illustration of the anti-ballistic fabric surface 22 used as a covering for a cushion or mattress 102 with handles 104 on both sides so that the cushion or mattress 102 can be held up in a defensive position if required.

Figure 18:
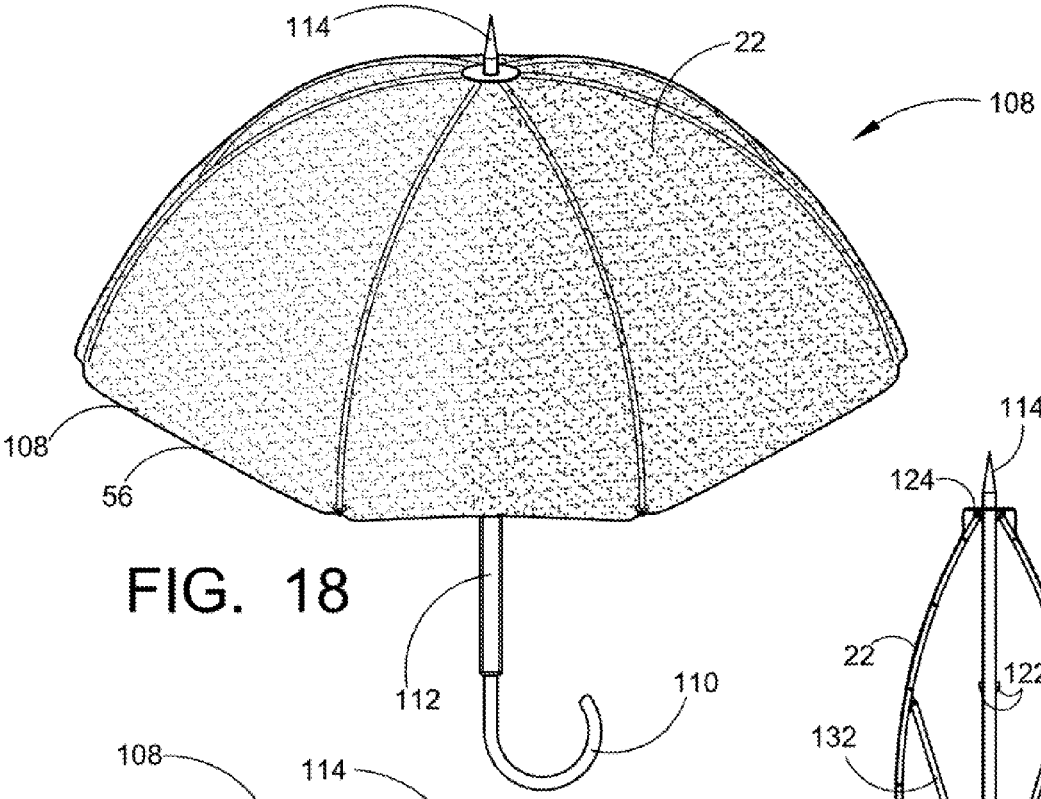
FIG. 18 depicts a perspective illustration of the anti-ballistic fabric surface used as a covering for a unique umbrella.

FIG. 18 depicts a perspective illustration of the anti-ballistic fabric surface 22 used as a covering for a unique umbrella 108 with the conventional shepherds hook handle 110 having an additional second hand support grip 112 and a defensive spike 114 on the top. A cable 56 is attached around the perimeter of the lower edge of the umbrella 108. Other handle arrangements are also anticipated by this invention.

Figure 19:
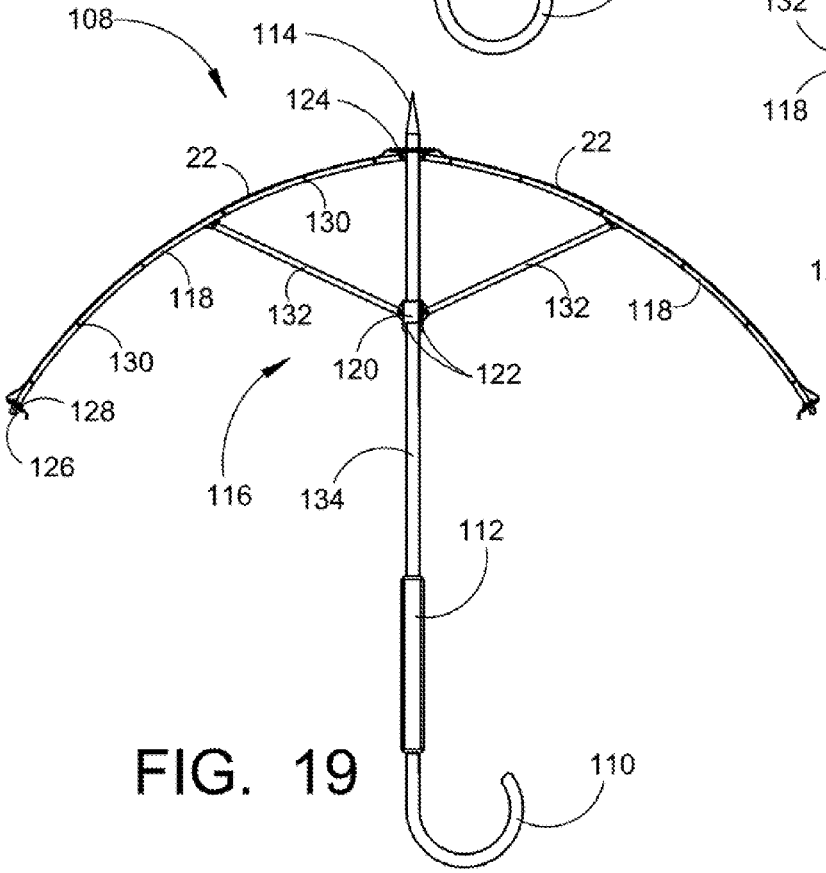
FIG. 19 depicts a side view of a section through the open umbrella frame illustrating the rigid or bendable rib members and the opening mechanism.

FIG. 19 depicts a side view of a section through the open umbrella frame 116 illustrating the rigid or bendable rib members 118 and the sliding opening mechanism 120 that are held in the open position, by the means of spring loaded latching mechanism 122. The anti-ballistic fabric surface 22 may in one embodiment be held in place by a large central grommet 124 at the top that will go over the defensive spike 114 and smaller grommets 126 located at the ends of the rib members 118 that are held in place by small grommet retainers 128. The anti-ballistic fabric surface 22 will also have intermittent ties or stitching 130 to each of the rib members 118. The sliding opening mechanism 120 will have extension arms 132 extending out to each of the rib members 118 supporting the umbrella 108 in the open position. The design of the umbrella 108 with fewer rigid rib members 118 compared to the conventional umbrella with flexible ribs is to accommodate the heavier weight of the anti-ballistic fabric surface 22. The central shaft 134 is fully exposed displaying the sliding opening mechanism 120 with the extension arms 132, spring loaded latching mechanism 122, the defensive spike 114 the shepherds hook handle 110 and the additional second hand support grip 112. It should be understood that the anti-ballistic umbrella may be constructed with any number of rib members depending upon the degree of bullet resistance desired. In this way, the umbrella may be constructed with fewer or more rigid or bendable rib members as needed.

Figure 20:
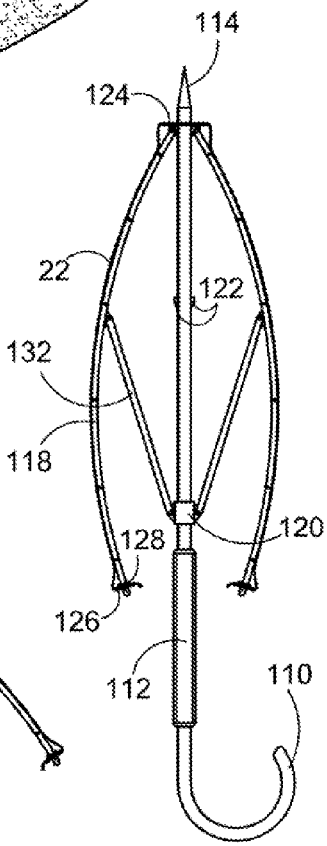
FIG. 20 depicts a side view of the closed umbrella frame illustrating the rigid or bendable rib members and the opening mechanism.

FIG. 20 depicts a side view of a section through the closed umbrella frame illustrating the rigid or bendable rib members 118 and the sliding opening mechanism 120 in the closed position. In an alternate embodiment, the previously described progressive expandable sleeve construction may be used. This construction calls for the addition of numerous stitches, including breakaway stitches and stronger holding stitches. The number of stitches and the relative strength of each stitch will depend upon the level and degree of bullet resistance desired or required by the user.

Figure 21:
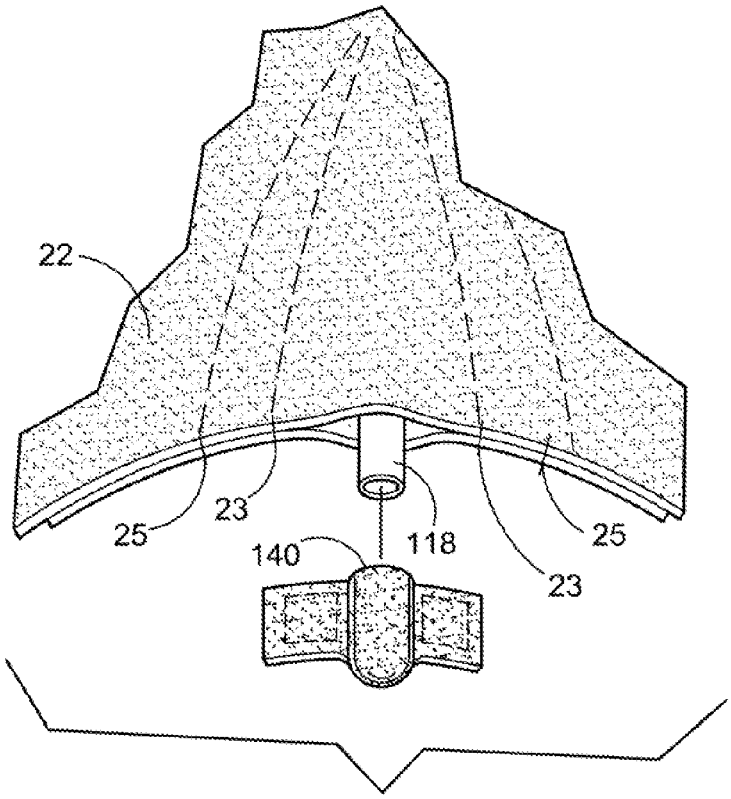
FIG. 21 depicts a perspective view of a single rib member end and the end covering cap.

FIG. 21 depicts a perspective view of a single rib member 118 end and the end covering cap 140.

Figure 22:
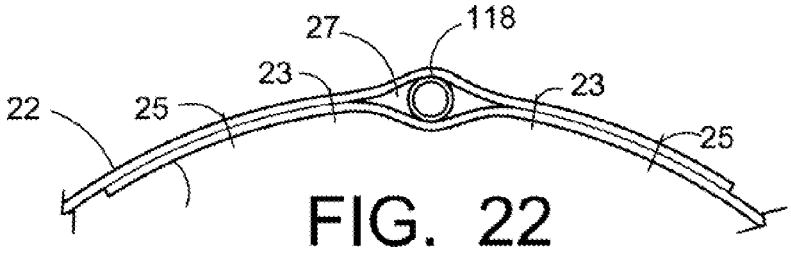
FIG. 22 depicts an end view of a single rib member.

FIG. 22 depicts an end view of a single rib member 118 illustrating the loose fit of the progressive expandable sleeve type of attachment anti-ballistic fabric surface 22 and the gap (or sleeve) 27 created on either side of the rib member 118. In an alternate embodiment the previously described progressive expandable sleeve construction may be used. This construction calls for the addition of numerous stitches, including breakaway stitches and stronger holding stitches. The number of stitches and the relative strength of each stitch will depend upon the level and degree of bullet resistance desired or required by the user.

Figure 23:
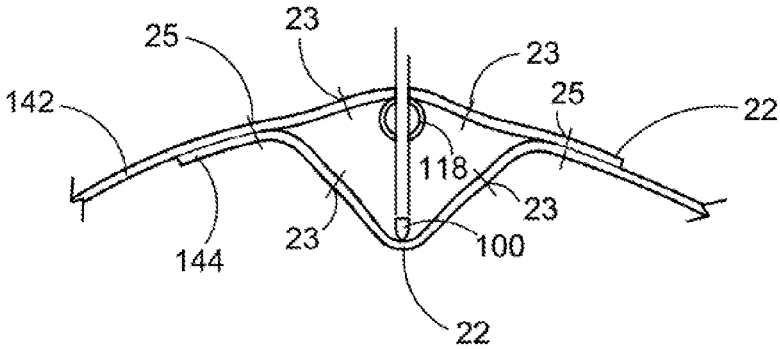
FIG. 23 depicts an end view of a single rib member when struck by a projectile.

FIG. 23 depicts an end view of a single rib member 118 when struck by a bullet 100 where the breakaway stitch 23 has broken away and deformed the anti-ballistic fabric surface 22 while the holding stitch 25 has resisted the forces. The bullet 100 has been shown easily penetrating the anti-ballistic fabric surface 22 top layer 142 and the rib member 118 but not being able to fully penetrate the anti-ballistic fabric surface 22 lower layers 144 due to the flexibility and breakaway stitching component of the construction.

The Anti-ballistic Shelters 10 shown in the drawings and described in detail herein disclose arrangements of elements of particular construction and configuration for illustrating preferred embodiments of structure and method of operation of the present application. It is to be understood, however, that elements of different construction and configuration and other arrangements thereof, other than those illustrated and described may be employed for providing an Anti-ballistic Shelters 10 in accordance with the spirit of this disclosure, and such changes, alternations and modifications as would occur to those skilled in the art are considered to be within the scope of this design as broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

I claim:

1. An anti-ballistic shelter comprising:

a frame comprising two or more support members; and one or more wall surfaces comprising a flexible high strength layered anti-ballistic material attached to said frame, wherein said flexible high strength layered anti-ballistic material is layered in at least two directions; and further wherein said layered anti-ballistic material is attached to said frame in an inverted T construction about said frame and including a breakaway stitch and a holding stitch therein.

2. The anti-ballistic shelter according to claim 1 wherein said flexible high-strength layered anti-ballistic material attached to said frame consists of anti-ballistic fabric layered in at least two directions, and further wherein said layered anti-ballistic material is wrapped around said frame and attached with clamps and fasteners.

3. The anti-ballistic shelter according to claim 2 wherein said flexible high-strength layered anti-ballistic material attached to said frame consists of anti-ballistic fabric layered in at least two directions and comprises polyethylene fibers combined with aramid fibers such as KEVLAR® para-aramid compounds.

4. The anti-ballistic shelter according to claim 2 wherein said frame comprises a mattress, pad or cot.

5. The anti-ballistic shelter according to claim 2 wherein said frame comprises a door or room divider.

6. The anti-ballistic shelter according to claim 1 wherein said flexible high-strength layered anti-ballistic material attached to said frame consists of anti-ballistic fabric layered in at least two directions and comprises polyethylene fibers GOLD SHIELD® woven polyethylene fibers and SPECTRA SHIELD® woven polyethylene fibers.

7. The anti-ballistic shelter according to claim 6 wherein said flexible high-strength layered anti-ballistic material attached to said frame includes anti-ballistic fabric layered in at least two directions comprising the woven polyethylene fiber material GOLD SHIELD® and SPECTRA SHIELD®, and further wherein these high-strength fibers are impregnated in partially cured resin.

8. The anti-ballistic shelter according to claim 6 wherein said frame comprises a pipe, rod, or tubular frame Quonset but with horizontal pipe members and hoop style pipe supporting members.

9. The anti-ballistic shelter according to claim 6 wherein said frame comprises a pup tent, dome tent or wall tent.

10. The anti-ballistic shelter according to claim 6 wherein said frame comprises an umbrella.

11. A method for making an anti-ballistic shelter comprising the steps of:

providing a frame comprising two or more support members; and providing one or more wall surfaces comprising a flexible high strength layered anti-ballistic material attached to said frame, wherein said flexible high strength layered anti-ballistic material is layered in at least two directions; and further wherein said layered anti-ballistic material is attached to said frame by sewing in an inverted T construction about said frame and including a breakaway stitch and a holding stitch therein.

12. The method of making an anti-ballistic shelter according to claim 11 wherein said flexible high-strength layered anti-ballistic material attached to said frame consists of anti-ballistic fabric layered in at least two directions, and further wherein said layered anti-ballistic material are wrapped around said frame and attached with clamps and fasteners.

13. The method of making an anti-ballistic shelter according to claim 12 wherein said flexible high-strength layered anti-ballistic material attached to said frame consists of anti-ballistic fabric layered in at least two directions and comprises polyethylene fibers combined with aramid fibers such as KEVLAR® para-aramid compounds.

14. The method of making an anti-ballistic shelter according to claim 12 wherein said frame comprises a mattress, pad or cot.

15. The method of making an anti-ballistic shelter according to claim 12 wherein said frame comprises a door or room divider.

16. The method of making an anti-ballistic shelter according to claim 11 wherein said flexible high-strength layered anti-ballistic material attached to said frame consists of anti-ballistic fabric layered in at least two directions and comprises polyethylene fibers GOLD SHIELD® woven polyethylene fibers and SPECTRA SHIELD® woven polyethylene fibers.

17. The method of making an anti-ballistic shelter according to claim 16 wherein said flexible high-strength layered anti-ballistic material attached to said frame includes anti-ballistic fabric layered in at least two directions comprising the woven polyethylene fiber material GOLD SHIELD® and SPECTRA SHTELD® and further wherein these high-strength fibers are impregnated in partially cured resin.

18. The method of making an anti-ballistic shelter according to claim 16 wherein said frame comprises a pipe, rod, or tubular frame Quonset but with horizontal pipe members and hoop style pipe supporting members.

19. The method of making an anti-ballistic shelter according to claim 16 wherein said flame comprises a pup tent, dome tent or wall tent.

20. The method of making an anti-ballistic shelter according to claim 16 wherein said frame comprises an umbrella.

* * * * *